US006613109B2

(12) United States Patent
Chandaria

(10) Patent No.: US 6,613,109 B2
(45) Date of Patent: Sep. 2, 2003

(54) PROCESS FOR MANUFACTURING ARTIFICIAL FIRELOGS

(76) Inventor: Ashok Velji Chandaria, P.O. Box 48870, Nairobi (KE)

( * ) Notice: Subject to any disclaimer, the term of this patent is extended or adjusted under 35 U.S.C. 154(b) by 0 days.

(21) Appl. No.: 09/955,014

(22) Filed: Sep. 18, 2001

(65) Prior Publication Data

US 2002/0007586 A1 Jan. 24, 2002

Related U.S. Application Data

(63) Continuation of application No. 09/301,295, filed on Apr. 28, 1999, now abandoned.

(51) Int. Cl.[7] ..... C10L 5/00

(52) U.S. Cl. ..... 44/535; 44/532; 44/596

(58) Field of Search ..... 44/535, 532, 530, 44/596

(56) References Cited

U.S. PATENT DOCUMENTS

| | | | | |
|---|---|---|---|---|
| 3,973,922 A | * | 8/1976 | Williams | 100/147 |
| 4,120,666 A | | 10/1978 | Lange | |
| 4,243,393 A | * | 1/1981 | Christian | 44/519 |
| 4,326,854 A | | 4/1982 | Tanner | |
| 4,670,018 A | * | 6/1987 | Cornwell | 44/522 |
| 5,496,384 A | | 3/1996 | Jeskey et al. | |
| 5,858,032 A | | 1/1999 | Hardy et al. | |

* cited by examiner

*Primary Examiner*—Cephia D. Toomer
(74) *Attorney, Agent, or Firm*—Sand & Sebolt

(57) ABSTRACT

An artificial firelog having a support surface, a viewing surface, and a pair of end surfaces is produced by moving a component mixture through an extrusion bore containing an extrusion die. The component mixture is divided by a blade extending the diameter of the extrusion die, thereby forming a flat rear surface on each stream of the component mixture. The blade additionally contains a cylindrical mandrel at approximately the center of the blade for forming a channel on the component mixture at substantially the center of the flat rear surface. The component mixture is then cut to desired lengths to form an artificial firelog.

20 Claims, 3 Drawing Sheets

PROCESS FOR MANUFACTURING ARTIFICIAL FIRELOGS

This application is a continuation of U.S. application Ser. No. 09/301,295 filed Apr. 28, 1999, now abandoned.

BACKGROUND OF THE INVENTION

1. Technical Field

This invention relates generally to a process for manufacturing artificial firelogs and, more particularly, to an extrusion process for manufacturing artificial firelogs having a flat rear surface. Specifically, the invention relates to a method for manufacturing artificial firelogs in which a component mixture is compressed through an extrusion die having a dividing blade traversing the die. The dividing blade, mandrel, and extrusion die cooperate to form a pair of firelogs having rounded front surfaces, a flat rear surface, and a channel down the rear surface.

2. Background Information

Various types of artificial firelogs have been developed and are well understood in the relevant art. These artificial firelogs are typically used in domestic fireplaces to produce aesthetically pleasing fires. The principal and by far most common use of the logs is in a domestic fireplace to provide an attractive fire closely simulating a wood fire and that is at least as safe, if not safer, than a wood fire.

These artificial firelogs are generally formed of particulate combustible materials that are compressed into a desirable shape. Most of these firelogs are formed of a particulate cellulosic material such as sawdust, although other combustible materials such as coal particles may be used. The particulate materials are combined with binder materials such as molasses, various waste oils or pitches, waxes, and other such combustible binders that maintain the shape of the firelog. Firelogs may also contain various types of additives that enhance burning characteristics, produce colored flames, or both.

Artificial firelogs made of combustible particulate materials and combustible binders are typically formed by a continuous extrusion process. In such a continuous extrusion process, the combustible particulate material, the combustible binder, and any desired additives are admixed to produce a component mixture. The component mixture is compressed within an extrusion bore with a screw extruder. The extruded stream passing through the extrusion bore is forced through an extrusion die to form the extruded component mixture into a desired size and shape. The extruded stream exiting the extrusion die is then cut to a desired length and placed into a protective wrapper.

Many artificial firelogs formed by extrusion are of a substantially cylindrical shape for the purpose of simulating a wooden log. Other firelogs contain various configurations intended to enhance the aesthetic qualities of the resultant fire, the burn characteristics of the firelogs, or the appearance of the firelog itself. The aesthetic qualities of the fire and the burn characteristics of the firelogs are among the most significant considerations in design and development of an artificial firelog.

Another consideration is the safety factors involved with burning an artificial firelog. Such safety factors relate to the stability of a partially burned firelog, the amount of heat generated by a burning firelog, and the length of time an artificial firelog will burn. The latter consideration, i.e., length of burning time, is an important safety consideration inasmuch as a burning firelog is preferably not left unattended since burning firelogs can cause dangerously high oxygen depletion and can potentially ignite the building structure. An artificial firelog thus should only burn for an appropriate period of time, remain structurally stable while burning, and not generate undue amounts of heat.

One firelog configuration that is aesthetically pleasing while being safe is the use of a pair of upstanding firelogs that have a flat rear surface and a curved front surface. A channel disposed on the rear surface helps position the firelog on a support. It is thus desired in the art to provide a method for manufacturing these logs that is inexpensive but consistently yields quality logs.

Various processes have been developed to fabricate safe artificial firelogs. For instance, U.S. Pat. No. 4,326,854 to Tanner discloses a process for making an artificial firelog in which a component mixture is compressed through an extrusion bore with the screw extruder, the screw extruder containing a cylindrical mandrel concentric with its axis of rotation whereby the rotating screw extruder and mandrel combination produce a hollow cylindrical firelog. While this process is effective for fabricating hollow logs, at least an additional step must be added to create the flat-backed logs discussed above.

While many possible configurations and processes exist for making firelogs, competition in the relevant industry mandates that artificial firelogs be produced as inexpensively as possible. It is thus desired to provide a process for manufacturing an artificial firelog having appropriate aesthetic, burning, and safety characteristics that can be inexpensively produced with existing machinery and existing assembly lines.

SUMMARY OF THE INVENTION

In view of the foregoing, an objective of the invention is to provide a process for manufacturing an artificial firelog having appropriate aesthetic, burning, and safety characteristics.

An additional objective of the invention is to provide a process for manufacturing an artificial firelog that is relatively inexpensive.

An additional objective of the invention is to provide a process for manufacturing an artificial firelog that produces a firelog having a stable support surface.

An additional objective of the invention is to provide a process for manufacturing an artificial firelog that can be used substantially in conjunction with existing machinery and production lines.

An additional objective of the invention is to provide a method for creating a pair of firelogs that each have a flat rear surface.

An additional objective of the invention is to provide a method for fabricating a pair of flat-backed firelogs wherein a support channel is formed in the flat rear surface.

An additional objective of the invention is to provide a method of fabricating artificial firelogs where two firelogs are fabricated simultaneously.

These and other objectives and advantages of the invention are obtained from the process for manufacturing artificial firelogs, the general nature of which can be stated as including the steps of moving the component mixture through an extrusion bore, dividing the component mixture, forming a rear surface on the component mixture, forming a channel on the component mixture, and cutting the component mixture to desired lengths.

BRIEF DESCRIPTION OF THE DRAWINGS

The preferred embodiment of the invention, illustrative of the best mode in which applicant has contemplated applying the principles of the invention, is set forth in the following description and is shown in the drawings and is particularly and distinctly pointed out and set forth in the appended claims.

Similar numbers refer to similar parts throughout the specification.

DESCRIPTION OF THE PREFERRED EMBODIMENTS

Figure 1:
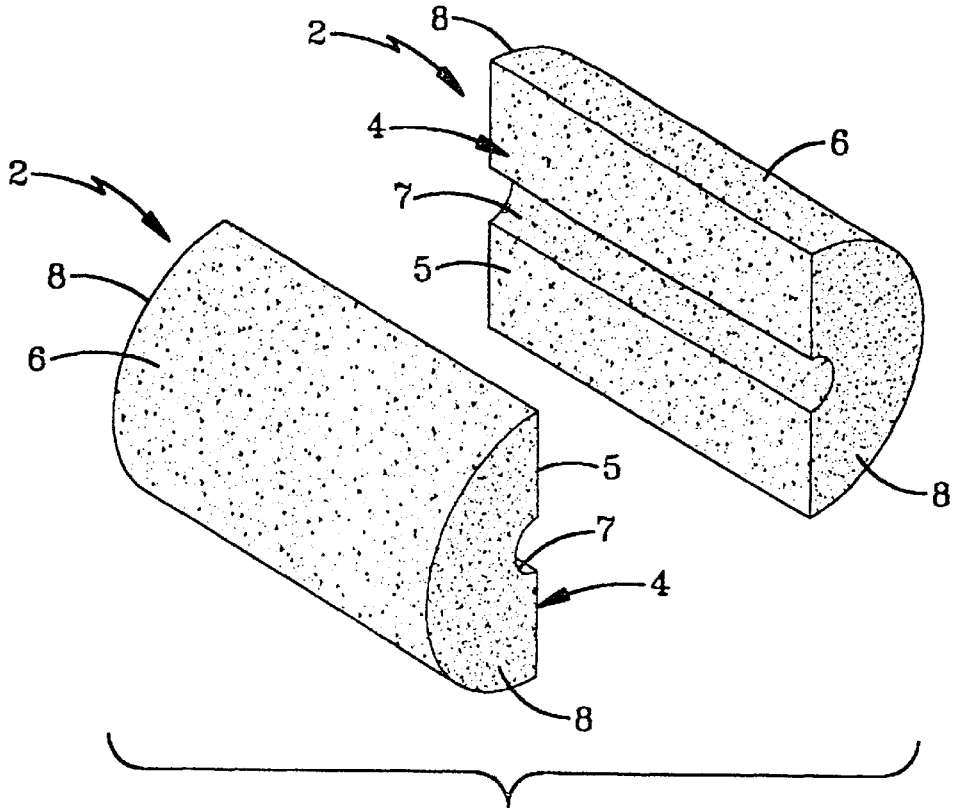
FIG. 1 is a perspective view of a pair of artificial firelogs produced by the process of the present invention.
Figure 2:
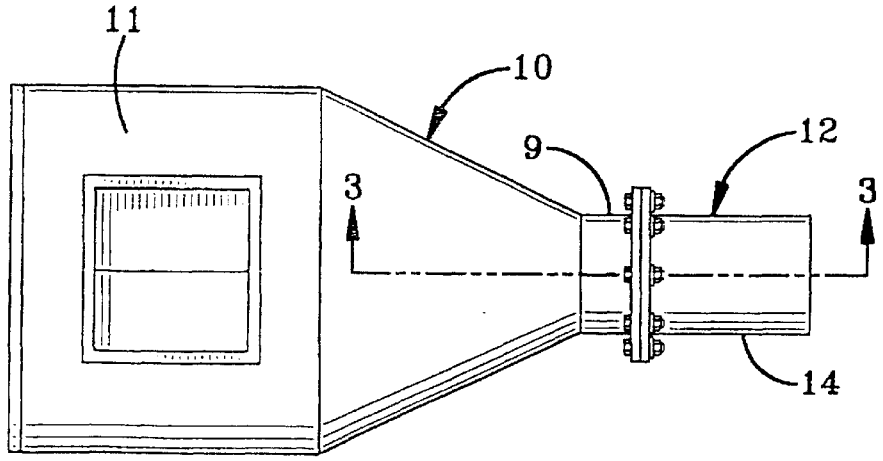
FIG. 2 is a top plan view of a screw extruder employed in the process of the present invention.

In accordance with the objectives, the process of the present invention produces a firelog indicated generally by the numeral 2. Firelog 2 is a solid body of a compressed component mixture comprising a matrix, a binder, and any of a number of additive materials, all of which are known and understood in the relevant art.

Firelog 2 is a partial cylindrical body having a support surface 4, a viewing surface 6, and a pair of end surfaces 8. Support surface 4 includes a substantially flat surface 5 and a channel 7. Channel 7 is a concave surface of constant cross section located at substantially the middle of flat surface 5. End surfaces 8 are flat surfaces at the ends of firelog 2 and are substantially perpendicular to flat surface 5. Viewing surface 6 is an arcuate surface of constant cross section extending between end surfaces 8 and terminating at flat surface 5.

The shapes and dimensions of firelog 2 may be changed to suit various considerations such as aesthetic beauty, burn characteristics of the firelog, and safety. With regard to safety, support surface 4 allows firelog 2 to rest against a corresponding surface on a firelog grate (not shown) that supports firelog 2 in an upright orientation while firelog 2 is burned. Channel 7 fits over a corresponding rib on the grate to laterally support firelog 2.

The component mixture of firelog 2 is preferably formulated such that firelog 2 retains its shape and does not crumble during burning and is capable of easy disposal. The matrix material may be sawdust or other appropriate cellulosic particulate material, or may be an alternate material such as coal powder. The binder material may be any of a variety of appropriate combustible binders such as waste oils, waxes, molasses, or other such material. Particular success has been found with the use of molasses at least 0.1% by weight, and preferably in approximately the range of 0.1%-30% by weight.

Firelog 2 is produced by moving the component mixture through an extrusion bore 9, dividing the component mixture, forming support surface 4 on the component mixture, forming channel 7 in support surface 4, and cutting the component mixture to desired lengths. After cutting, firelog 2 may be placed into a protective wrapper (not shown) or other packaging for shipping.

The component mixture is first placed into the hopper 11 of an extrusion processor 10 that is adapted to compress the component mixture through extrusion bore 9. Extrusion bore 9 typically includes an extrusion die 12 for shaping and forming the compressed component mixture into a desired shape. In the preferred embodiment, extrusion die 12 is a separate component attached to extrusion processor 10 by known means, although in other embodiments extrusion die 12 may be formed integrally with extrusion processor 10. The ability to remove and replace extrusion die 12 permits the user to substitute different extrusion dies suited to produce firelogs of different sizes and shapes as desired. Additionally, the ability to install extrusion die 12 on an existing extrusion processor permits firelog 2 to be produced using existing production equipment and existing production lines.

In accordance with the objectives of the present invention, the component mixture is divided by moving it past a blade 18 having a cutting edge 22 at its leading end. In dividing the component mixture with blade 18 the component mixture is separated into discrete streams. Inasmuch as the component mixture is compressed while passing through the extrusion die, the component mixture is likewise compressed against a pair of substantially planar flattening surfaces 24 contained on alternate sides of blade 18. Flattening surfaces 24 serve to form flat surfaces 5 on firelog 2. Cutting edge 22 may be either sharp or rounded depending upon the composition of the component mixture.

Figure 3:
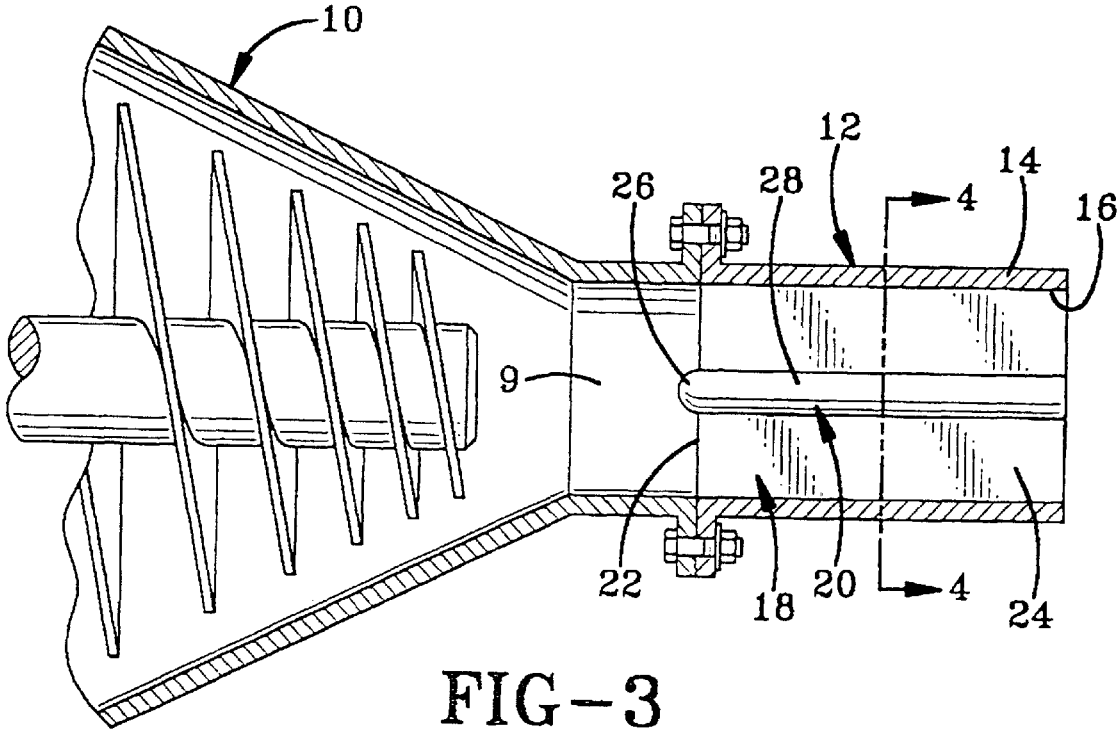
FIG. 3 is a sectional view of the screw extruder employed in the process of the present invention as shown along line 3—3 of FIG. 2.

Simultaneously with the component mixture passing blade 18, the component mixture passes over a mandrel 20 as it passes over flattening surfaces 24. In accordance with the objectives of the present invention, mandrel 20 forms channel 7 as firelog 2 is formed. Mandrel 20 has a partial substantially spherical forming surface 26 at the leading edge thereof and contains an arcuate smoothing surface 28 of substantially cylindrical section downstream of forming surface 26. While forming surface 26 in the preferred embodiment is of a spherical section, forming surface 26 may likewise be of other appropriate shapes such as conic or parabolic without departing from the spirit of the present invention. As can be seen in FIG. 3, forming surface 26 preferably protrudes from cuffing edge 22, although other configurations are possible without departing from the spirit of the present invention.

As the component mixture passes through extrusion die 12, forming surface 26 forms channel 7 substantially contemporaneously with the dividing of the component mixture by cutting edge 22. Thereafter, smoothing surface 28 further serves to form channel 7 contemporaneously with the formation of flat surfaces 5 by flattening surfaces 24.

The location of mandrel 20 at substantially the center of blade 18 results in forming channel 7 at substantially the center of flat surface 5 on support surface 4 of firelog 2. The cylindrical nature of smoothing surface 28 causes channel 7 to be also of a partial cylindrical nature having a constant section along the length of firelog 2. It is understood that mandrel 20 and the resultant channel 7 may be of a non-cylindrical section to match the corresponding fireplace grate (not shown) against which support surface 4 will rest.

As the component mixture passes through extrusion die 12, the component mixture likewise passes through housing 14 of extrusion die 12. Blade 18 is securely mounted in housing 14, and mandrel 20 is, in turn, mounted at substantially the center of blade 18. The inner surface of housing 14 defines a shaping surface 16 that forms viewing surface 6 on firelog 2 as the component mixture passes therethrough. In the preferred embodiment, shaping surface 16 is of partial substantially cylindrical section, although other shapes and configurations are known and understood in the art and are possible without departing from the spirit of the present invention. The passing of the component mixture across shaping surface 16 causes viewing surface 6 to be formed of a corresponding shape.

Figure 4:
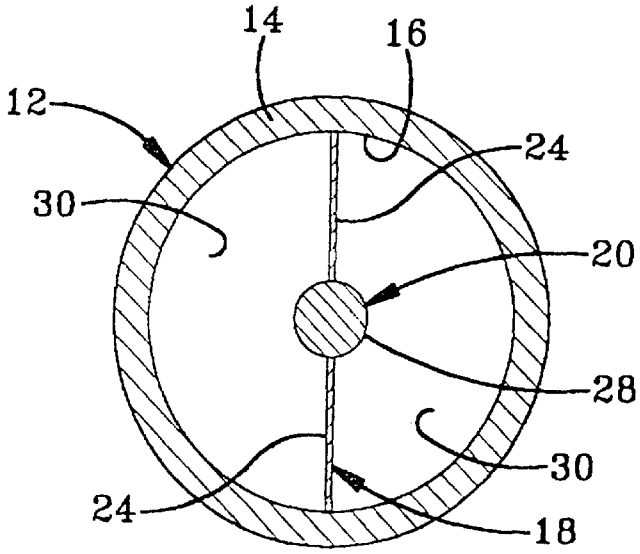
FIG. 4 is a sectional view of an extrusion die employed in the process of the present invention as shown along line 4—4 of FIG. 3.
Figure 5:
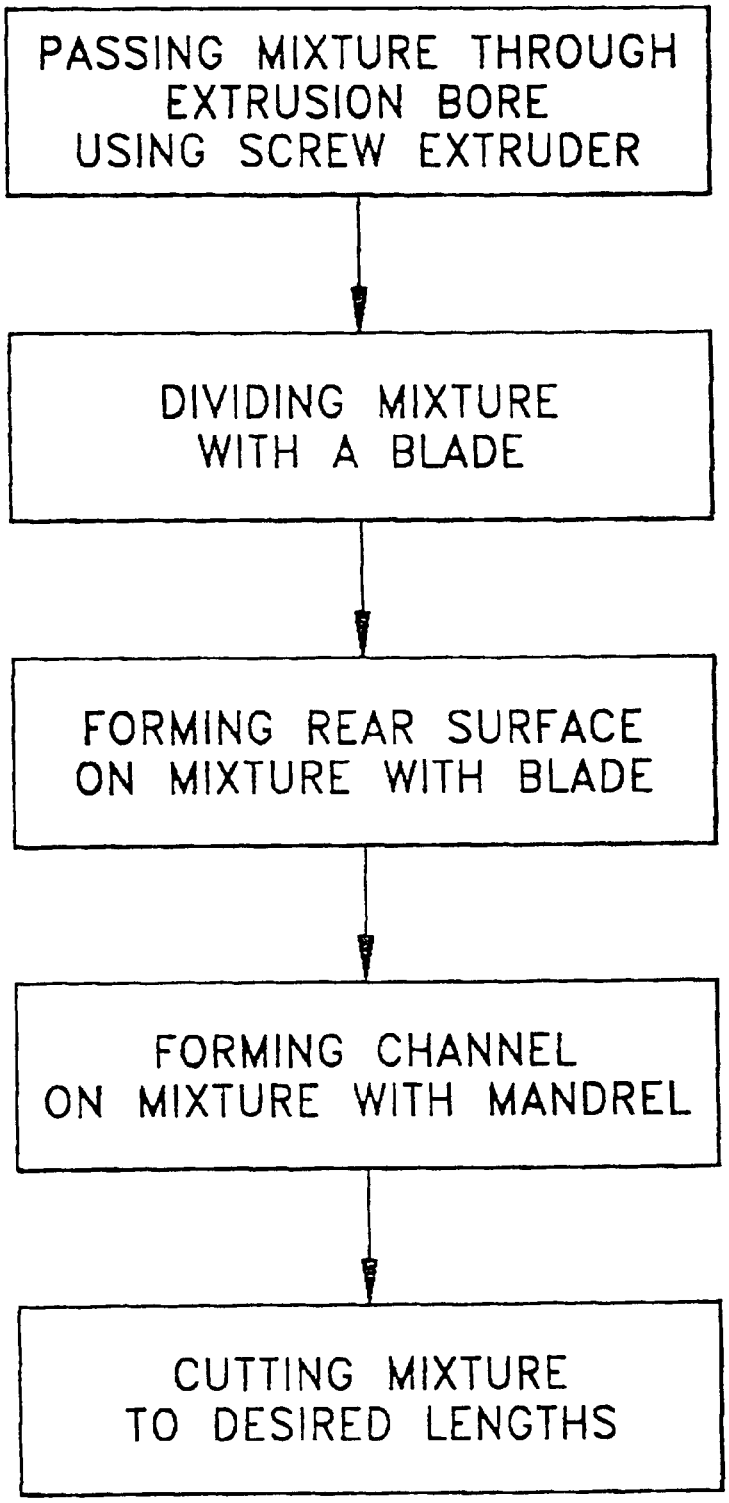
FIG. 5 is a flowchart showing an exemplary embodiment of the process of the present invention.

As can be seen in FIG. 4, extrusion die 12 contains a pair of openings 30. Each opening 30 contains a perimeter defined by shaping surface 16, flattening surface 24, and smoothing surface 28. In accordance with the objectives of the present invention, the compressed component mixture exiting each opening 30 is of a shape corresponding to the cross section of firelog 2.

Once the component mixture has exited each opening 30, the compressed streams of component mixture are then cut to desired lengths. The action of cutting the exiting compressed component mixture forms end surfaces 8. In the preferred embodiment, end surfaces 8 are substantially planar and perpendicular to flat surfaces 5, although other shapes and configurations are possible without departing from the spirit of the present invention.

The cutting of the exiting compressed component mixture forms a pair of substantially identical firelogs 2. Each firelog 2 is then preferably wrapped in a protective wrapping (not shown).

In use, support surface 4 of firelog 2 is placed against a corresponding support member of a fireplace grate (not shown). In accordance with the objectives of the present invention, support surface 4 is stable and supports firelog 2 on the fireplace grate while firelog 2 is burned. Firelog 2 is, therefore, formed in an aesthetically pleasing fashion in accordance with one or more design criteria, and contains an appropriately stable support surface.

Accordingly, the improved process for manufacturing artificial firelogs apparatus is simplified, provides an effective, safe, inexpensive, and efficient device that achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the process for manufacturing artificial firelogs is constructed and used, the characteristics of the construction, and the advantageous new and useful results obtained; the new and useful structures, devices, elements, arrangements, parts, and combinations are set forth in the appended claims.

What is claimed is:

1. A process for manufacturing an artificial firelog from a component mixture that includes a matrix material and a binder material, said process comprising the steps of:

moving the component mixture through an extrusion bore;

forming a substantially flat rear surface on the component mixture;

forming a log retaining channel in the flat rear surface of the component mixture; and cutting the component mixture to desired lengths.

2. The process as set forth in claim 1 in which the step of forming a channel includes the step of forming the channel at substantially the center of the rear surface.

3. The process as set forth in claim 1 in which the step of forming a channel includes the step of forming the channel to be of a substantially semi-circular cross-section.

4. The process as set forth in claim 1 in which the step of cutting includes the step of forming a pair of end surfaces that lie substantially perpendicular to the flat rear surface.

5. The process as set forth in claim 4 further comprising the step of forming a substantially semi-circular outer surface on the component mixture, the outer surface terminating at the rear surface and at the end surfaces.

6. The process as set forth in claim 1 further comprising the step of forming a pair of substantially identical firelogs each time the extruded component mixture is cut.

7. A process for manufacturing an artificial firelog from a component mixture that includes a matrix material and a binder material, said process comprising the steps of:

moving the component mixture through an extrusion die having at least two openings so that two streams of component mixture are extruded through the die;

forming a substantially flat rear surface on each stream of the component mixture;

forming a channel in the flat rear surface of each stream of the component mixture; and cutting each stream of the component mixture to desired lengths.

8. The process as set forth in claim 7 in which the step of forming a channel includes forming the channel at substantially the center of the flat rear surface of each stream of the component mixture.

9. The process as set forth in claim 8 in which the step of cutting forms a pair of end surfaces that lie substantially perpendicular to the flat rear surface of each stream of the component mixture.

10. The process as set forth in claim 9 further comprising the step of forming a substantially semi-circular outer surface on each stream of the component mixture, the outer surface terminating at the rear surface and at the end surfaces.

11. The process as set forth in claim 9 further comprising the step of compressing the component mixture as it moves through the extrusion bore.

12. The process as set forth in claim 9 further comprising the step of forming a pair of substantially identical firelogs each time the extruded component mixture is cut.

13. A process for manufacturing an artificial firelog from a component mixture that includes a matrix material and a binder material, said process comprising the steps of:

moving the component mixture through an extrusion bore;

passing the component mixture over a dividing blade extending across the diameter of the extrusion bore so that the mixture is formed into two streams;

compressing the component mixture against the dividing blade;

forming a flat rear surface on each of the streams;

forming a channel in each stream of the component mixture with a mandrel mounted to substantially the center of the dividing blade wherein the log retaining channel is formed in the flat rear surface of each stream; and cutting the component mixture to desired lengths.

14. The process as set forth in claim 13 which the step of cuffing includes the step of forming a pair of substantially flat end surfaces substantially perpendicular to the rear surface of each stream.

15. The process as set forth in claim 14 further comprising the step of forming a substantially semi-circular outer surface on each stream of the component mixture, the outer surface terminating at the rear surface and at the end surfaces.

16. The process as set forth in claim 15 further comprising the step of forming a pair of substantially identical firelogs each time the extruded component mixture is cut.

17. The process as set forth in claim 1, further comprising the step of dividing the component mixture, wherein the step of dividing the mixture occurs simultaneously with the step of forming a flat rear surface on the component mixture.

18. The process as set forth in claim 1, wherein the steps of forming a flat rear surface in the component mixture and of forming a channel in the flat rear surface occur simultaneously.

19. The process as set forth in claim 7, wherein the steps of forming a flat rear surface in the component mixture and of forming a channel in the flat rear surface occur simultaneously.

20. The process as set forth in claim 13, wherein the steps of forming a flat rear surface the component mixture and of forming a channel in the flat rear surface occur simultaneously.

* * * * *